US005283999A

United States Patent [19]

Cooney et al.

[11] Patent Number: 5,283,999

[45] Date of Patent: Feb. 8, 1994

[54] PREFABRICATED PANEL FOR BUILDING CONSTRUCTION

[75] Inventors: Frank J. Cooney, Lake Worth; Donald H. Dworkes, Margate, both of Fla.

[73] Assignee: Novatek International, Inc., Boynton Beach, Fla.

[21] Appl. No.: 715,494

[22] Filed: Jun. 14, 1991

[51] Int. Cl.[5] ..... E04B 5/14; E04C 2/28

[52] U.S. Cl. ..... 52/583; 52/706

[58] Field of Search ..... 52/250, 602, 704, 583, 52/584, 587, 585, 706

[56] References Cited

U.S. PATENT DOCUMENTS

| | | | |
|---|---|---|---|
| 1,259,698 | 3/1918 | Wilson | 52/602 |
| 1,379,754 | 5/1921 | Forrester | 52/698 |
| 1,677,372 | 7/1928 | Ruhling | 52/587 |
| 1,924,801 | 8/1933 | Olmsted | 52/602 |
| 1,948,093 | 2/1934 | Baird et al. | 52/707 |
| 2,192,182 | 3/1940 | Deutsch | 52/584 |
| 2,324,326 | 7/1943 | Schwendt | 52/250 |
| 2,675,694 | 4/1954 | Betsold | 52/587 |
| 3,279,135 | 10/1966 | Jacobsen | 52/583 |
| 3,476,912 | 11/1969 | Garrison | 52/235 |
| 3,505,768 | 4/1970 | Bentley | 52/704 |
| 3,810,339 | 5/1974 | Russo | 52/707 |

FOREIGN PATENT DOCUMENTS

| | | | |
|---|---|---|---|
| 137394 | 5/1948 | Australia | 52/703 |
| 715775 | 8/1965 | Canada | 52/704 |
| 86371 | 3/1921 | Fed. Rep. of Germany | 52/698 |
| 2387329 | 12/1978 | France | 52/235 |

*Primary Examiner*—James L. Ridgill, Jr.

*Attorney, Agent, or Firm*—James A. Quinton; Frank Frisenda, Jr.

[57] ABSTRACT

A concrete panel is provided having a threaded cylindrical concrete insert imbedded therein for receipt of a bolt. Preferably, the concrete inserts are imbedded in each corner of the panel. The inserts have an opening on at least one end thereof for receipt of a securing bolt after they have been imbedded in the concrete panel. Each insert has a passageway which allows a reinforcing bar to pass through the cylindrical insert. The concrete inserts can extend the entire thickness of the panel and the cylindrical bore opens on both sides of the panel. As a result the panel can be secured from either side during construction of a building. The panel can then be made with one style or configuration on one side and a different style on the other side. Thus, two different style buildings can be constructed from the panels.

11 Claims, 2 Drawing Sheets

FIG. 1
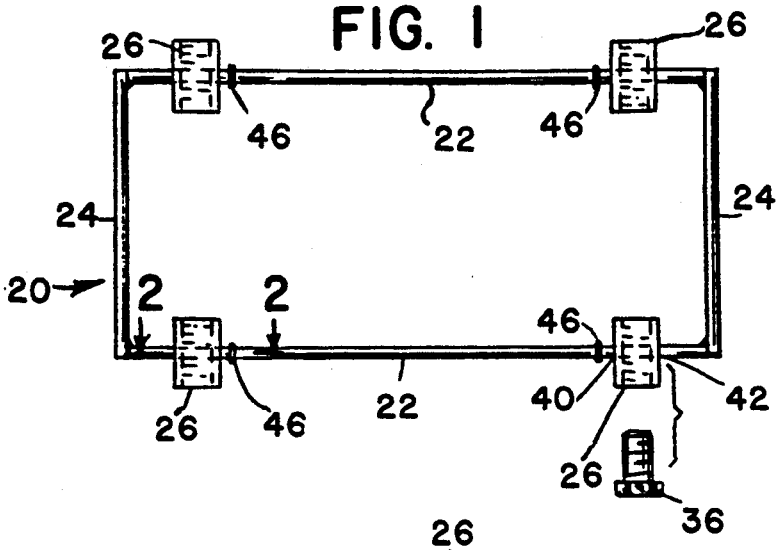
FIG. 2
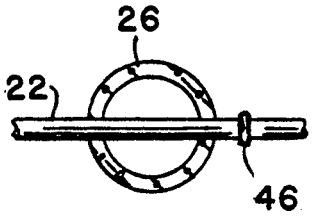
FIG. 3
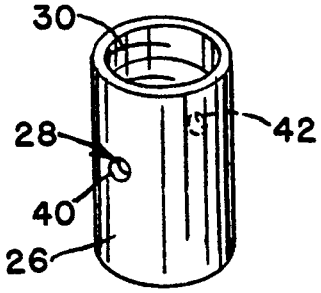
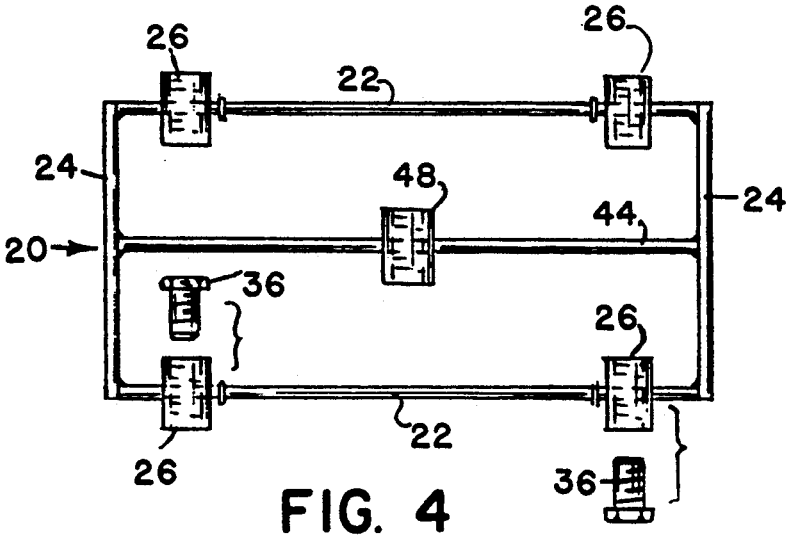
FIG. 4

PREFABRICATED PANEL FOR BUILDING CONSTRUCTION

BACKGROUND OF THE INVENTION

1. Field of the Invention

The subject invention relates to improved concrete building panels and the improved system for construction of concrete buildings.

2. Description of the Prior Art

There is a wide array of building panels available in the prior art. Building panels have been designed so that overhanging tongue in groove connectors or shoulders align to provide a tight fit. See, for example, U.S. Pat. No. 4,727,701. In addition, nuts have been imbedded in panels to receive bolts so the panels may be anchored into place. See, for example, U.S. Pat. Nos. 4,727,701 and 4,909,009. It is important that such nuts are firmly imbedded in the concrete so the nuts are not pulled from the concrete when the panels are bolted to the supporting frame. It is also important that the nuts do not migrate to the outer surface and crack the panels. It is known in the prior art to provide metal reinforcing bars around the periphery of the panels. However, location of the bars during manufacture and migration of the bar to the surface of the frame can be a problem.

C-channels have been used in the prior art to support cement or concrete building panels. See, for example, U.S. Pat. No. 4,602,467. In addition, I-beams have been used to provide such support. I-beams provide superior strength to C-channel construction due to increased mass and strength provided by the I-beams. However, I-beams are expensive and are difficult to work with due to their weight. Construction of I-beam frames need to be done on site, and often require the use of heavy equipment such as cranes.

SUMMARY OF THE INVENTION

The present invention is directed to an improved prefabricated cement or concrete panel and an improved system for building construction using same and an improved mold for making such panels. According to the invention, a concrete panel is provided having a threaded concrete insert imbedded therein for receipt of a bolt. The insert has a threaded cylindrical bore for receipt of a bolt. At least two concrete inserts are imbedded in the panel. Preferably, the concrete inserts are imbedded in each corner of the panel. The inserts have an opening on at least one end thereof for receipt of a securing bolt after they have been imbedded in the concrete panel. Each insert has a passageway located transverse to the cylindrical threaded bore of the insert. This passageway allows a reinforcing bar to pass through the cylindrical insert.

Reinforcing bars are provided around the periphery of the panel. Preferably the reinforcing bars are welded together to form a unitary, generally rectangular configuration. Two or more inserts and preferably four (4) inserts are provided along the reinforcement bars. Prior to welding the reinforcing bars together, the inserts are placed along the reinforcing bar by passing two of the bars preferably the longest pair of reinforcing bars which are normally the horizontal bars through the transverses passageway in the insert and locating two inserts adjacent both ends of each bar. The reinforcing bar-concrete insert assembly is then placed in a mold which is filled with cement and allowed to harden. After the cement has hardened, the reinforcing bars securely hold the concrete inserts and substantially retard their migration to the surface or the dislodgement of the connectors from the panel by pulling forces as a result of the weight of the panels or from hurricane or other stresses on the building. Consequently, the failure rate of the panels from insert failure or dislodgment is reduced.

Optionally, an additional reinforcing bar can be welded to the middle of the reinforcing bar-concrete insert assembly. In this instance, an additional connector can be provided in the middle of the structure to provide an additional mounting location on the panel.

In another aspect of the invention, the concrete inserts extend the entire thickness of the panel. The cylindrical bore opens on both sides of the panel. As a result the panel can be secured from either side during construction. The panel can then be made with one style or configuration on one side and a different style on the other side. Thus, two different style buildings can be constructed from the panels. In addition, objects such as decorative facade, flower boxes or the like can be bolted to the building.

In another aspect of the invention, a mold is provided for forming the concrete panels according to the invention. The mold includes at least two and preferably four unthreaded projections for engagement in the bores of the insert to hold the insert and reinforcing bars in the proper location during the hardening of the cement.

The preferred embodiment of the present invention is illustrated in the drawings and examples. However, it should be expressly understood that the present invention should not be limited solely to the illustrative embodiment.

DETAILED DESCRIPTION OF THE DRAWINGS

FIG. 1 is a perspective view of the reinforcing bar-concrete insert assembly according to the invention.

FIG. 2 is cross section of FIG. 1 through 2—2 of the reinforcing bar-concrete insert assembly according to the invention.

FIG. 3 is a perspective view of the concrete insert according to the invention.

FIG. 4 is a perspective view of an alternate reinforcing bar-concrete insert assembly according to the invention.

DETAILED DESCRIPTION OF THE INVENTION

Figure 5:
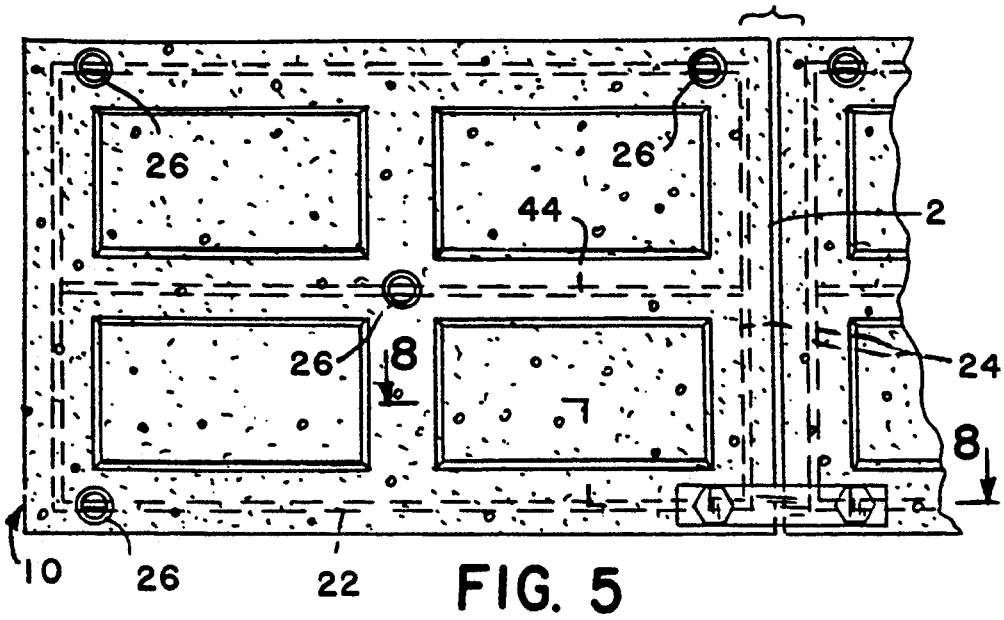
FIG. 5 is a front view of a concrete panel according to the invention connected to an adjacent panel.

The present invention relates to an improved prefabricated concrete or cement panel and an improved concrete insert and reinforcing bar-concrete insert assembly for use in prefabricated concrete or cement panels. In another aspect of the invention a mold for construction of concrete panels is provided.

According to the invention, a reinforcing bar-concrete insert assembly is provided for imbedding in a concrete panel. The assembly includes two or more concrete inserts and preferably includes four concrete inserts integrally connected to the reinforcing bars and located in the finished concrete panel adjacent to the corners thereof. Generally, the finished panel is generally rectangular. Preferably, the horizontal dimension of the panel is greater than the vertical dimension. Optionally the panels can be square.

The insert has a cylindrical threaded bore for receipt of a bolt to connect the insert to a supporting structure. Each insert has a passageway located transverse to the cylindrical threaded bore for receiving the reinforcing bar. The reinforcing bar-concrete insert assembly is preferably provided by passing the reinforcing bars through the passageway of the concrete insert. Preferably the concrete inserts are provided along the longer pair of reinforcing bars which is generally referred to as the horizontal reinforcing bars. However, the concrete inserts could be optionally placed on the shorter or vertical bars as well. Preferably four inserts are provided along the reinforcement bars and most preferably two inserts are provided on each horizontal reinforcing bar adjacent to the end thereof. After placement of the concrete inserts near the end of each side of the horizontal reinforcement bars, the reinforcement bars are affixed to one another, preferably by welding or the like to provide a unitary structure. Preferably prior to mounting the concrete inserts, the reinforcing bars are compressed out of round or crimped so that the concrete inserts can be positioned on the bar.

Optionally, one or more additional bars can be welded to the assembly. Preferably an additional horizontal bar is provided horizontally across the middle of the assembly to provide added strength. Optionally a fifth insert is provided in the middle of such additional bar or rod to provide an additional location to bolt the panel to a supporting structure.

Prefabricated panels are constructed using the reinforcing bar-concrete insert assembly. The assembly is placed in a mold which is then filled with cement and allowed to harden to form the panel. After the cement has hardened, the reinforcing bars securely hold the concrete inserts in place and substantially retard any migration of the inserts to the surface. Moreover, the reinforcing bars help prevent failure of the panel from any pulling forces which might pull the concrete inserts out of the cement. As a result the concrete inserts are a unitary part of the reinforcing bars and dislodgment of the concrete insert would require dislodgment of the reinforcing bars as well. In another aspect of the invention, the concrete insert extend through the entire thickness of the panel. The cylindrical bore of the concrete insert in such an embodiment opens on both ends of the panel. As a result the panel can be secured from either side during construction. Thus, a single panel can be provided with two different styles finishes, one on either side. The panels can be mounted to have either style on the outside of the building. Additionally, the outward facing bolt receiving opening can be used to bolt objects such as facade, e.g., wooden facing, flower boxes or gutter drain piping.

In another aspect of the invention, a mold is provided for forming the concrete panels according to the invention. The mold include at least two unthreaded projections and preferably four for engagement with the concrete inserts. During the manufacturing of the panels, the reinforcing bar-concrete insert assembly is mounted on the mold by placing the unthreaded projections through the concrete inserts. Thus, the location of the reinforcing bars and the concrete inserts can be easily controlled in the manufacturing process. As a result when the cement hardens, the reinforcing bars are in the proper location and the cured panel can be easily removed from the mold.

As best can be seen with reference to the drawings and as shown in FIG. 1, a reinforcing bar-concrete insert assembly 20 is provided having horizontal reinforcing bars 22 and vertical reinforcement bars 24 which are welded to the horizontal reinforcement bars 22 to form a generally square or rectangular structure. At least two concrete inserts and preferably four concrete inserts 26 are provided along the reinforcing bars. Preferably the concrete inserts 26 are located along the horizontal reinforcing bars 22 from about 1" to 3" from the end thereof. The reinforcing bar has an insert positioner 46 for locating the concrete insert in place on the bars. Preferably the bar is compressed out of round or crimped at a point about 1" to 3" from the end of the bars. The crimp is about ¼" and prevents the inserts from travelling toward the middle of the reinforcing bars. Optionally the inserts can be located along the vertical reinforcing bars 24. In another aspect of the invention as best seen in FIG. 4, an additional reinforcing bar can be provided to the reinforcing bar-concrete insert assembly. Desirably, the additional reinforcing bar will be a horizontal bar welded to the middle of each vertical bar.

However, an additional welded vertical reinforcing bar may be provided. When an additional reinforcing bar 44 is provided, an additional concrete insert 48 as shown in FIG. 4 can be provided. Preferably the fifth insert 48 is located at the mid-point of the additional reinforcing bar 44 to provide an additional bolt securing location for mounting the panel.

The assembly 20 is simple and easy to manufacture. Two concrete inserts are mounted along each horizontal bar 22 by sliding the inserts onto bar 22 through the concrete insert passageway 28 so that the reinforcing bar travels through inlet 40, cylindrical bore 30 and outlet 42. The concrete insert 26 is then slid along the reinforcing bar 22 until it reaches insert positioner 46 which is the crimped portion of bar 22 so that the concrete insert is located at a predetermined position at the end of horizontal bar 22. After the four inserts 26 are mounted on the reinforcing bars 22, bars 22 are welded to bars 24 to form a generally rectangular assembly for use in forming the concrete panel 10.

Figure 6:
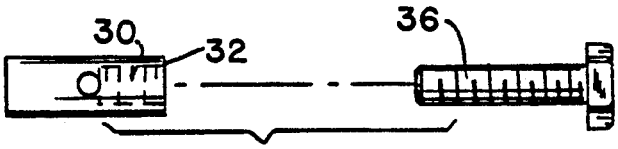
FIG. 6 is a side view of the concrete insert and connector according to the invention.
Figure 7:
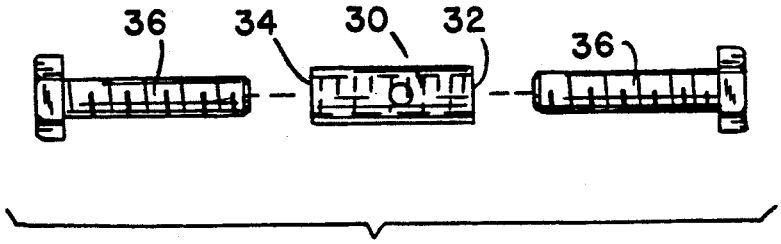
FIG. 7 is a side view of an alternative embodiment of the concrete insert according to the invention.
Figure 8:
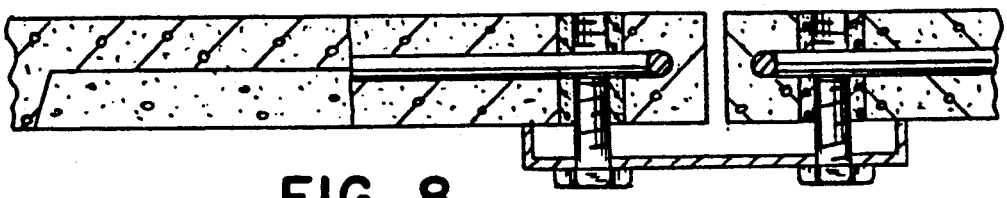
FIG. 8 is a cross-sectional view of the panel according to the invention connected to an adjacent panel.

The concrete inserts according to the invention as best shown in FIGS. 2, 3, 6 and 7 have a passageway 28, for the receipt of a reinforcing bar. The passageway 28 is defined by reinforcing bar inlet and outlet 40 and 42 and bolt receiving bore 30. The concrete inserts have a threaded bolt receiving bore 30 for receipt of a securing bolt 36 through opening 32. Optionally as seen in FIG. 7, the bolt receiving bore 30 extends the entire length of the concrete insert and a second bolt receiving opening 34 is provided. When such an embodiment as FIG. 6 is provided, the concrete insert 26 will extend the entire thickness of the concrete panel 10. As a result there will be a bolt receiving opening on both sides of the concrete panel. This allows one to provide the different style panels by having different style finishes on the front and back of the panel. The additional bolt receiving positions on the outer surface of the panels can also be used to mount objects to the surface of the building such as flower boxes, facade or gutter drains.

As best seen in FIG. 5 when the concrete panel according to the invention has been formed, it includes concrete inserts 26, preferably four concrete inserts adjacent to the corners of the panel. Optionally a fifth concrete insert 48 is located at the middle of the panel. Four reinforcing bars are provided, horizontal bars 22 and vertical bars 24. Optionally a additional reinforcing bar can be provided either horizontally or vertically. Preferably as shown in FIG. 5, a horizontal reinforcing bar 44 is provided with an insert 48 located in the middle thereof. The additional reinforcing bar 44 is welded to the vertical bars 24 at approximately the mid-point of the bars.

In manufacture of the panel, the reinforcing bar-concrete insert assembly 20 is placed in a mold which preferably has projections for receipt of concrete inserts 26. Desirably the mold includes at least two projections and preferably four for insertion into the concrete inserts 26. As a result, the assembly is held in place so that upon hardening of the panel, the assembly 20 is properly located in the panel 10. Since the mold projections are not threaded, the hardened panel 20 can be easily dislodged from the mold after hardening. The resulting hardened panel has the reinforcing bars 22 and 24 and the concrete inserts 26 precisely located in the panel. Such manufacture is easily accomplished and time saving since the operator does not have to adjust the location of the reinforcing bars nor does he have to locate and position the concrete inserts. All that is necessary is that the assembly 20 be placed on top of the proper projections. When the embodiment of FIG. 7 is used, that is, with a concrete projection which is open at both ends and which extend the length of the panel, optionally a cap can be provided to prevent the inadvertent entry of any cement into the insert.

The foregoing is considered as illustrative only of the principles of the invention. Further, since numerous changes and modifications will occur to those skilled in the art, it is not desired to limit the invention to the exact construction and operation shown and described above, and accordingly all suitable modifications and equivalents may be resorted to, falling within the scope of the invention.

We claim:

1. A precast concrete panel for nesting securely side by side to form a building wall comprising:

a threaded bolt receiving insert imbedded in each corner of said panel;

said insert extending through the entire thickness of said panel;

each said insert having a cylindrical threaded bore therethrough;

said threaded bore having an opening on the top and bottom surfaces of said panel for receipt of a securing bolt;

each said insert having a passageway located transverse to said cylindrical threaded bore of said insert for receiving a reinforcing bar therethrough so when said panel has hardened, said reinforcing bars securely hold said inserts in position;

the front of said panel having a different aesthetic appearance than the appearance of the back of said panel;

said panel reversibly mountable to a supporting structure so that either the front or the back of said panel can form a part of the exterior wall of a building.

2. A precast concrete panel according to claim 1 wherein said concrete inserts are imbedded in each corner of said panel.

3. A generally rectangular concrete panel for nesting side by side to form a building wall comprising:

a) a first, second, third and fourth adjoining reinforcing bar imbedded in said panel;

b) said reinforcing bars extending around the periphery of said panel;

c) each said reinforcing bar directly welded at each end to the adjoining reinforcing bar to form a unitary reinforcing bar structure;

d) said reinforcing bar structure having a generally rectangular shape with said first reinforcing bar being generally parallel to said third reinforcing bar and said second reinforcing bar being generally parallel to said fourth reinforcing bar;

e) a first, second, third, fourth concrete insert mounted to said first and third reinforcing bars;

f) said first and second concrete inserts located adjacent to opposite ends of said reinforcing bar and imbedded in said panel;

g) said third and fourth concrete inserts located adjacent opposite the ends of the third reinforcing bar;

h) said concrete inserts having a cylindrical threaded bore for receipt of a threaded bolt;

i) said insert having a passageway located transverse to the cylindrical threaded bore for mounting said insert on the end of said reinforcing bar so that when said panel hardens, said inserts and reinforcing bars form a substantially unitary structure to retard panel failure due to pulling force on the insert when the panel is mounted to a supporting structure in the formation of a building;

j) said first and third reinforcing bars having a notch adjacent to each end thereof to receive and hold said inserts adjacent the end of said reinforcing bars;

whereby said reinforcing bars and said concrete inserts can be easily placed and held in a concrete mold in the desired position during manufacture of the panel.

4. The concrete panel according to claim 3 wherein said panel is generally square.

5. The concrete panel according to claim 3 wherein said first and third reinforcing bars are longer than said second and fourth reinforcing bars.

6. The concrete panels according to claim 3 wherein said reinforcing bars are affixed to one another by welding.

7. The concrete panel according to claim 3 further comprising said concrete insert extending the entire depth of the panel;

said threaded bore having a bolt receiving opening on both ends thereof for bolting said panel to a supporting structure from the front or the back of said panel and for bolting objects to the front of said panel after said panel has been bolted to said supporting structure;

said front of said panel having a different aesthetic appearance than the appearance of the back of said panel;

said panel reversibly mountable to a supporting structure so that either the front or the back of said panel can form a part of the exterior wall of a building.

8. The concrete panel according to claim 7 further comprising a fifth reinforcing bar embedded in said panel affixed at one end to the mid-point of said second reinforcing bar and affixed at the opposite end to the mid-point of said fourth reinforcing bar;

a fifth concrete insert embedded in said panel mounted to said fifth reinforcing bar and located at the mid-point of said fifth reinforcing bar.

9. The concrete panel according to claim 7 wherein said first and third reinforcing bars are longer than said second and fourth reinforcing bars.

10. The concrete panel according to claim 7 wherein said first and third reinforcing bars have insert positioning means adjacent to each end thereof to hold said inserts a predetermined distance from the end of said reinforcing bars.

11. The concrete panels according to claim 7 wherein said reinforcing bars are affixed to one another by welding.

* * * * *